US007781686B2

(12) United States Patent
Kramlich

(10) Patent No.: US 7,781,686 B2
(45) Date of Patent: Aug. 24, 2010

(54) OPERATING ELEMENT WITH A CENTRAL PUSHBUTTON

(75) Inventor: Andreas Kramlich, Schweinfurt (DE)

(73) Assignee: Preh GmbH (DE)

( * ) Notice: Subject to any disclaimer, the term of this patent is extended or adjusted under 35 U.S.C. 154(b) by 141 days.

(21) Appl. No.: 12/014,757

(22) Filed: Jan. 15, 2008

(65) Prior Publication Data

US 2008/0245650 A1 Oct. 9, 2008

Related U.S. Application Data

(63) Continuation of application No. PCT/EP2006/006416, filed on Jul. 1, 2006.

(30) Foreign Application Priority Data

Jul. 15, 2005 (DE) ..... 10 2005 033 129
Sep. 7, 2005 (DE) ..... 10 2005 045 462

(51) Int. Cl.
*H01H 25/04* (2006.01)

(52) U.S. Cl. ..... 200/6 A

(58) Field of Classification Search ..... 200/4, 200/5 R, 6 A, 18; 341/20, 35; 345/156, 157, 345/160, 161, 163, 167, 168, 169, 184
See application file for complete search history.

(56) References Cited

U.S. PATENT DOCUMENTS 5,621,196 A 4/1997 Nishijima et al.
6,344,618 B1 * 2/2002 Sato ..... 200/6 A
6,377,239 B1 * 4/2002 Isikawa ..... 345/156
6,403,898 B2 * 6/2002 Janniere et al. ..... 200/6 A
6,563,488 B1 * 5/2003 Rogers et al. ..... 345/163
6,570,107 B1 * 5/2003 Nishimoto et al. ..... 200/6 R
6,618,036 B1 * 9/2003 Tanaka ..... 345/161
6,995,326 B2 * 2/2006 Sugimura et al. ..... 200/5 R
7,534,973 B2 * 5/2009 Voelckers ..... 200/5 R

FOREIGN PATENT DOCUMENTS

| | | |
|---|---|---|
| DE | 1190 081 | 4/1965 |
| DE | 100 49 111 A1 | 6/2001 |
| DE | 101 52 978 A1 | 4/2003 |
| EP | 1 031 905 A2 | 8/2000 |
| EP | 1 241 694 A2 | 9/2002 |

* cited by examiner

*Primary Examiner*—Michael A Friedhofer
(74) *Attorney, Agent, or Firm*—Cantor Colburn LLP

(57) ABSTRACT

An operating element is provided that has a control knob, which is mounted in a housing, a console, or the like, and can move in a swiveling manner between a home position and multiple switching or contact positions. In order to design the operating element in a simple way, a central momentary switch that establishes the switch actuation point of the operating element and has a haptic function is associated with the control knob, and the momentary switch is actuated each time the control knob is swiveled out of its home position by a predefined angle toward a switching or contact position.

14 Claims, 6 Drawing Sheets

15
2
7
17
16
13

13
7
9
15
17
16

7
2
17
16
13

OPERATING ELEMENT WITH A CENTRAL PUSHBUTTON

This nonprovisional application is a continuation of International Application No. PCT/EP2006/006416, which was filed on Jul. 1, 2006, and which claims priority to German Patent Application Nos. DE 102005033129 and DE 102005045462, which were filed in Germany on Jul. 15, 2005 and Sep. 7, 2005, respectively, and which are both herein incorporated by reference.

BACKGROUND OF THE INVENTION

1. Field of the Invention

The present invention relates to an operating element with a control knob, which is mounted in a housing or console or the like, and can move in a swiveling manner between a home position and multiple switching or contact positions.

2. Description of the Background Art

Joystick-type operating elements of this nature are known, and are used in practice in a wide variety of fields in order to control machines, software programs, etc. In particular, the operating elements are used in motor vehicles to control a navigation system or an on-board computer. In this case, the operating element is frequently located in the center console between the driver and passenger seats, making the control options clearly visible to the driver.

Known from DE 101 52 978 A1, for example, is an operating element which is flat in design and is conceived such that the control knob can be tilted into four different switching or contact positions, wherein in each case a dome that is provided on the control knob and has a corresponding contact dot comes into contact with a printed circuit board and presses the board elastically downward, thus also providing haptic feedback information to the user.

Other conventional operating elements ensure that only one instance of contact takes place in each swivel position of the control knob. However, some consider it expensive that each switching position has its own contact element with haptic function.

SUMMARY OF THE INVENTION

It is therefore an object of the present invention to provide an operating element that has a simple construction.

This object is attained according to the invention in that a central momentary switch that establishes the switch actuation point of the operating element and has a haptic function is associated with the control knob, and the momentary switch is actuated each time the control knob is swiveled out of its home position by a predefined angle toward a switching or contact position.

The invention thus is based on the concept of providing a central momentary switch that is used in all directions of tilt to establish the haptic behavior as well as the switch actuation point or switching threshold of the operating element. This ensures that the switch actuation point and the haptic behavior is the same for all contact or switching positions. A further advantage of the invention consists in that the switching function is decoupled from the direction sensing. As a result, standard components can be used for the momentary switch and contact elements, making the operating element simple in construction and economical to manufacture. Moreover, the switch actuation point of the momentary switch and contact closure of the contact element can take place with staggered timing. In useful fashion, the contact elements are arranged such that detection of a switching position takes place with a smaller tilt angle of the shaft than the switching function of the momentary switch. This makes the actual switching function of the operating element reliable.

According to an embodiment of the invention, provision is made that the momentary switch is depressed during a swiveling motion of the control knob out of its home position into a contact position against the restoring force of an elastic element. Alternatively, the momentary switch can be depressed when the control knob is in its home position, and be released and raised by an elastic element associated with the momentary switch when the control knob is swiveled into a contact position. When the control knob is supported on the housing by at least one elastic element and pressed into its home position, the elastic element contributes to the haptic behavior of the operating element in that a push or pull function (push or pull behavior) is produced. In this context, it is possible to support the control knob by a central spring on the housing so that the control knob is centered by means of the spring. Alternatively, it is possible to use multiple smaller springs for each direction of tilt.

In a further embodiment, the control knob can be located at a free end of a shaft which is swivel-mounted in the housing, or console, or the like. In this case, the momentary switch can be associated with the end of the shaft opposite the control knob, wherein the end of the shaft opposite the control knob can then in useful fashion stand in direct contact with the momentary switch. Alternatively, it is possible to associate with the momentary switch a tappet, guided in the longitudinal direction, which contacts the momentary switch at one end and is operatively connected at its other end to the shaft in such a manner that a swiveling motion of the shaft is translated into an axial motion of the tappet. For example, it is possible to arrange, between the momentary switch and the tappet, a ball that is mounted in a conical recess in the face of the tappet.

Pairs of cooperating contact elements can be provided, one half of each pair being on the shaft and the other half on the housing, wherein one of the pairs of the contact elements works together in each contact position to provide contact. In this context, mechanical contacts or optical or magnetic sensors may be employed as contact elements. In particular, it is possible to design pressure-sensitive films as contact elements or to design the contact elements to carry current so that a circuit is closed in the event of a contact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figures 1A, 1B, 1C:
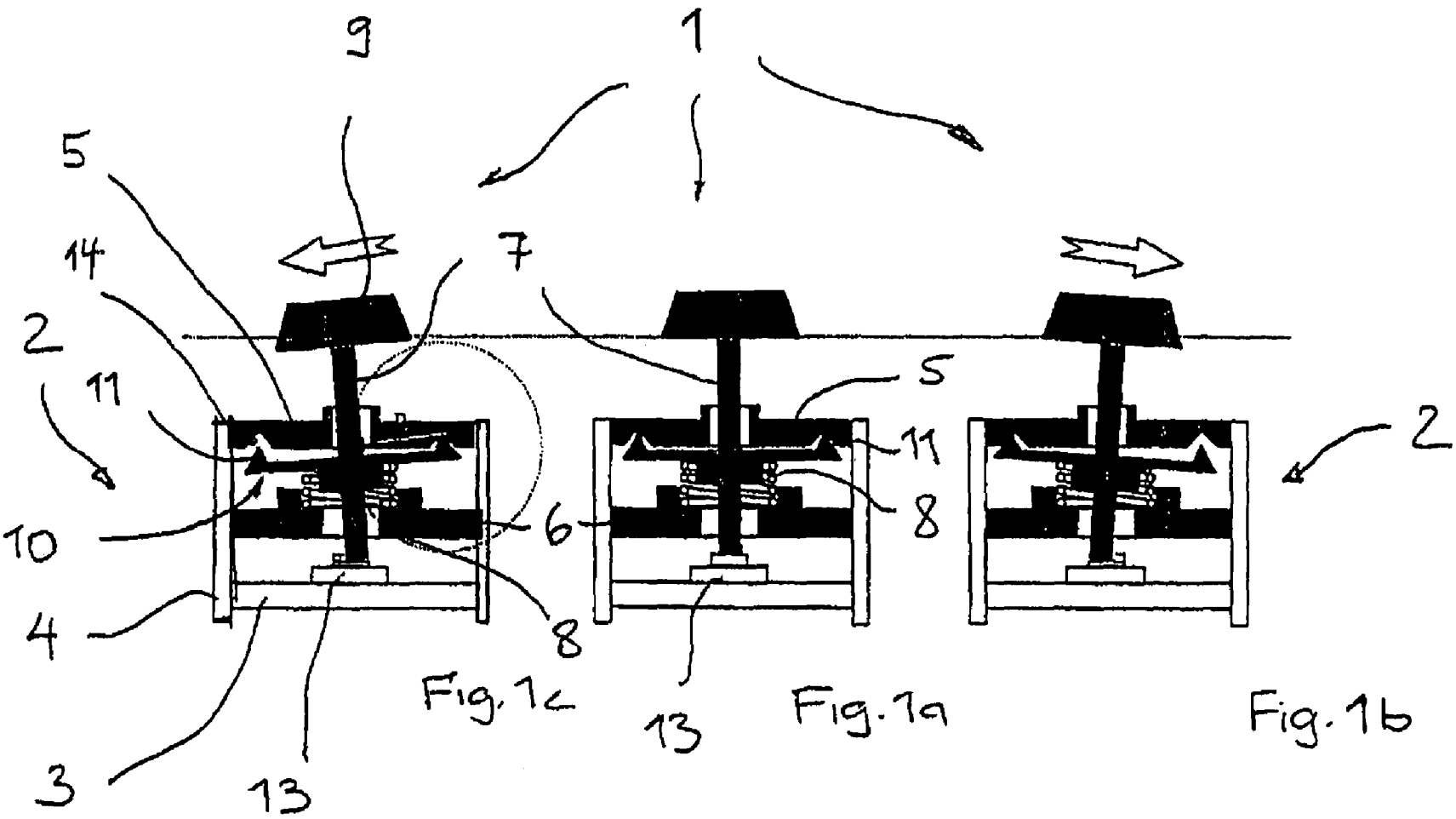
FIGS. 1*a* to 1*c* illustrate a schematic representation of a first embodiment of an inventive operating element in its home position and two switching positions.

Shown in FIGS. 1*a* through 1*c* is a first embodiment of an inventive operating element 1, which is used in motor vehicles, for example, in order to control a navigation system, an on-board computer, or the like. Here, FIG. 1 shows the operating element 1 in its home position, while FIGS. 1*b* and 1*c* show the operating element in two switching positions. The operating element 1 includes a housing 2 with a base plate 3, side elements 4, and a cover plate 5, which here takes the form of a printed circuit board. Located between the base plate 2 and the cover plate 5 is a separator plate 6.

The operating element 1 also includes a shaft 7 that is located in the housing 2 and whose upper end projects out of the housing 2, bearing a control knob 9. The shaft 7 is swivel-mounted in the housing 2 such that it can be swiveled between the upright home position shown in FIG. 1*a* and a total of four contact or switching positions: to the right (FIG. 1*b*), to the left (FIG. 1*c*), and forward and rearward out of the plane of the illustration. The shaft 7 is pressed into its home position by a central helical compression spring 8, which is braced between the separator plate 6 and a contact plate 10 located on the shaft 7, so that the contact plate 10 is pressed against the cover plate 5.

Four pairs of contact elements 11, 12 in all are arranged on the contact plate 10 and the cover plate 5, offset by 90° from one another, wherein one pair of contact elements 11, 12 is associated with each of the four possible switching positions of the shaft 7 and produces a contact when the switching position is reached.

Also provided on the base plate 3 of the housing 2 is a momentary switch 13, which the shaft 7 rests upon in its home position. The momentary switch 13 is depressed when the shaft 7 is swiveled out of the home position (see FIG. 1*a*) into one of its switching or contact positions (see FIGS. 1*b* and 1*c*). The central momentary switch 13 has a haptic function, which establishes together with the central spring 8 the haptic behavior of the swiveling motion, and the switch also determines the switch actuation point of the operating element 1. Specifically, the arrangement is made such that the sensing of a switching position occurs at a smaller angle of tilt of the shaft 7, and thus sooner than the switching of the momentary switch 13. This ensures that a particular switch state is always determined solely by the switch actuation point established by the momentary switch 13.

Figures 2A, 2B, 2C:
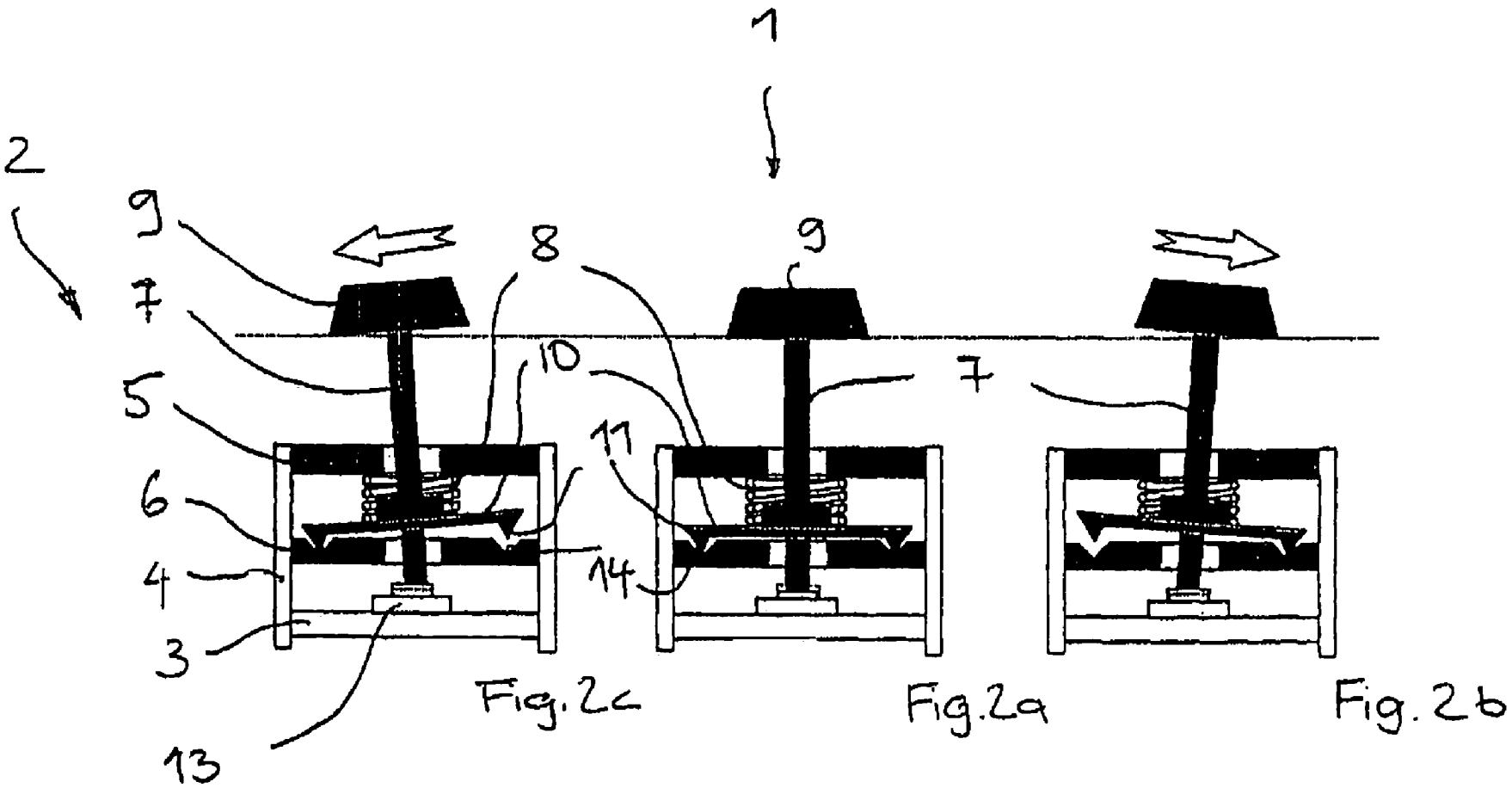
FIGS. 2*a* to 2*c* illustrate a schematic representation of a second embodiment of an inventive operating element in its home position and two switching positions.

In the embodiment shown in FIGS. 1*a* through 1*c*, the operating element 1 has a so-called push function, which is to say that during a swiveling motion the shaft 7 with the control knob 9 must be pushed down out of its home position into one of its contact positions against the restoring force of the central spring 8. If a push function is not desired, a pull function can also be implemented as an alternative. Such a function is implemented in the second embodiment of an inventive operating element 1 as represented in FIGS. 2*a* through 2*c*; this embodiment has a basic construction similar to the first embodiment. In the second embodiment, however, the shaft 7 is pressed downward against the separator plate 6 in the form of a printed circuit board by a central compression spring 8 that braces itself between the cover plate 5 of the housing 2 and the contact plate 10 provided on the shaft 7. In this process, the momentary switch 13 provided on the base plate 3 in the embodiment shown in FIG. 2 is also pushed down by the shaft 7, and is not released into one of its contact or switching positions until a swiveling motion of the shaft 7 occurs, so that it is raised from the depressed position by a restoring element provided in the momentary switch 13, causing it to switch. During the pivoting motion of the shaft 7 into a switching position, the contact plate 10 must be raised against the restoring force of the central spring 8, thus achieving the pull function.

In the embodiments shown in FIGS. 1 and 2, a switching direction is sensed when a contact takes place between a contact element 11 provided on the contact plate 10 and a corresponding contact element 12 on the printed circuit board 5 or 6 (see FIGS. 1*b* and 2*c* left, FIGS. 1*c* and 2*b* right). For example, the contact elements 11 or 12 can be designed to be electrically conductive, so that an electric circuit is closed in the event of contact. Alternatively, it is possible for the contact elements 11, 12 to use pressure-sensitive films (force sensing resistor, FSR, technology).

Figure 4:
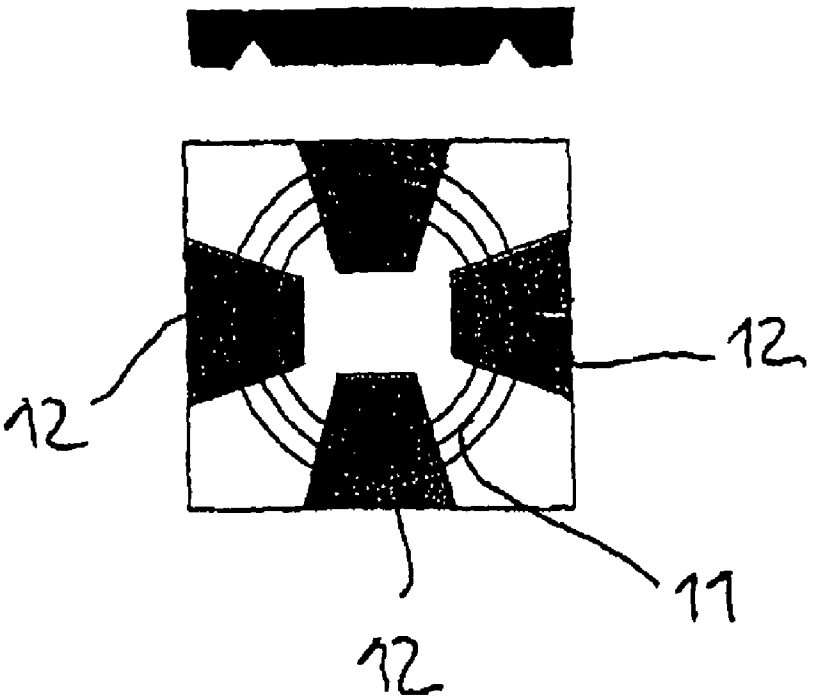
FIG. 4 is a schematic top view of the contact area of the contact elements of an inventive operating element.
Figure 3:
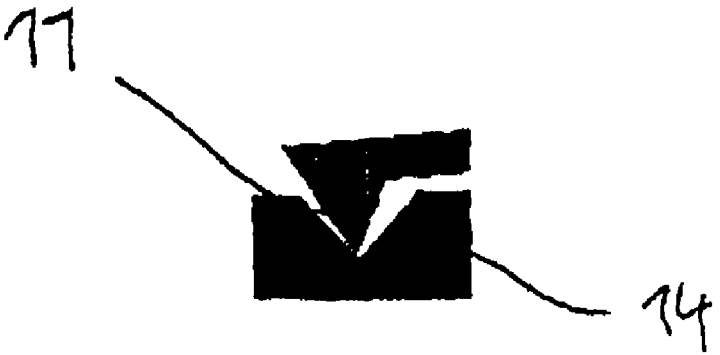
FIG. 3 is an enlarged view of section Z from FIG. 2.

To permit precise switching operations, the contact elements 11 of the contact plate 10 are composed of an annular boss with a wedge-shaped cross section, which stands in engagement with a corresponding annular and V-shaped groove 14 of the printed circuit board 5, 6 in which the four contact elements 12 on the circuit board side are provided at the appropriate circumferential segments, as is clearly visible in FIGS. 3 and 4. This arrangement ensures that, in each switching position, only a single mechanical point of contact is present between the wedge-shaped annular boss of the contact plate and the V-shaped groove 14 of the printed circuit board 5, 6, and is unambiguously determined in accordance with the direction of tilt with respect to the switch actuation point that is defined by the momentary switch 13. Moreover, this embodiment offers the advantage that the contact plate 10 and the printed circuit board 5, 6 are always aligned with respect to one another without play when the contact plate 10 is pressed against the circuit board 5, 6 by the central spring 8 in the home position of the shaft 7. The arrangement thus makes it possible to guide the joystick in a conical bearing, thereby avoiding any bearing play whatever.

Figures 5A, 5B, 5C:
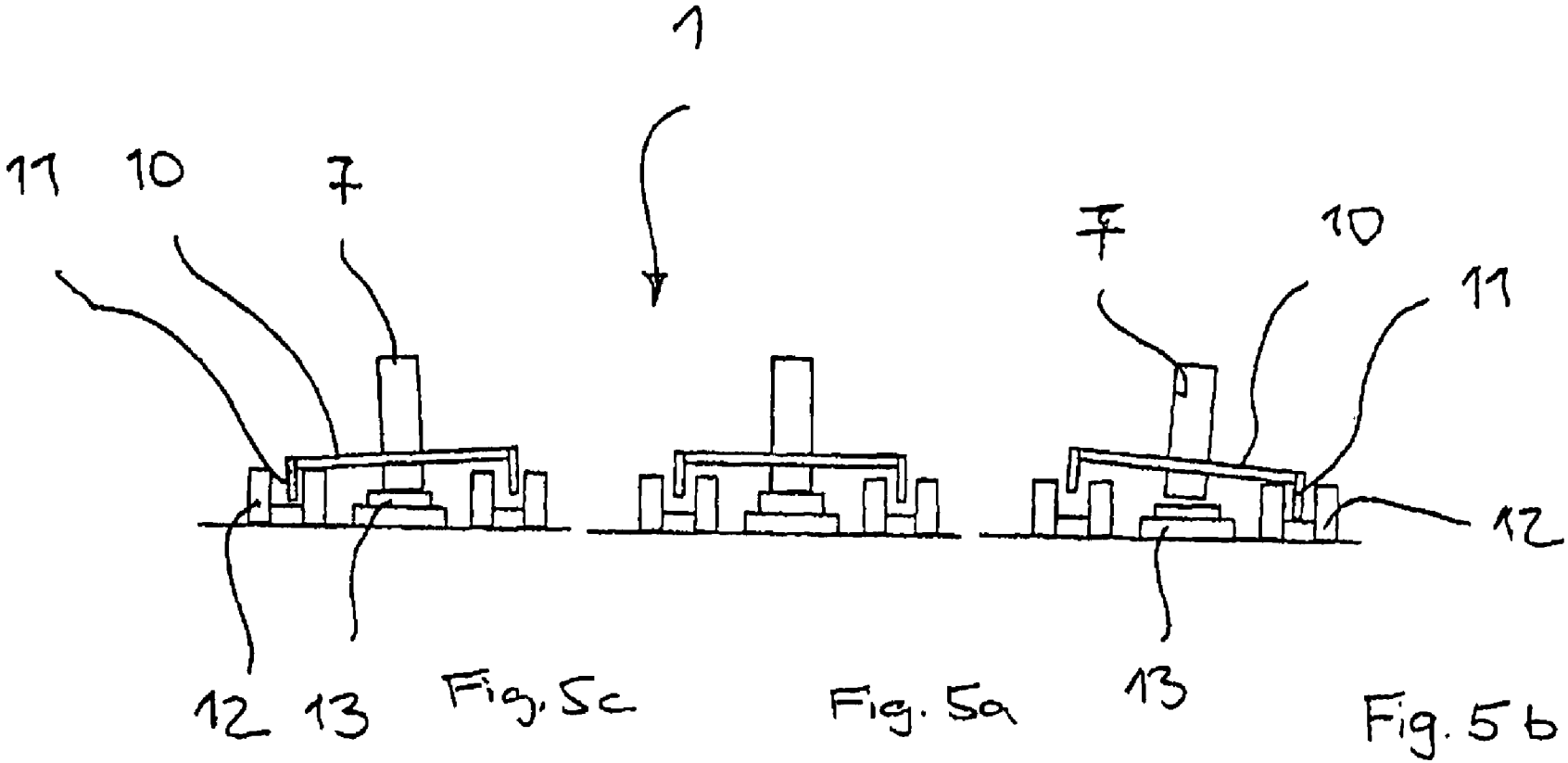
FIGS. 5*a* to 5*c* illustrate a schematic representation of a third embodiment of an inventive operating element in its home position and two switching positions.

Alternatively, it is possible to employ contact elements that operate without physical contact. In the third embodiment shown in FIGS. 5*a* through 5*c*, for example, optical sensors in the form of branched optical interrupters 12 are placed on the printed circuit board 3 for sensing direction; when tilting into a switching position occurs, the light path of these interrupters is interrupted by a shield element 11 provided on the contact plate 10 of the shaft 7, thus achieving direction sensing.

Figures 6A, 6B, 6C:
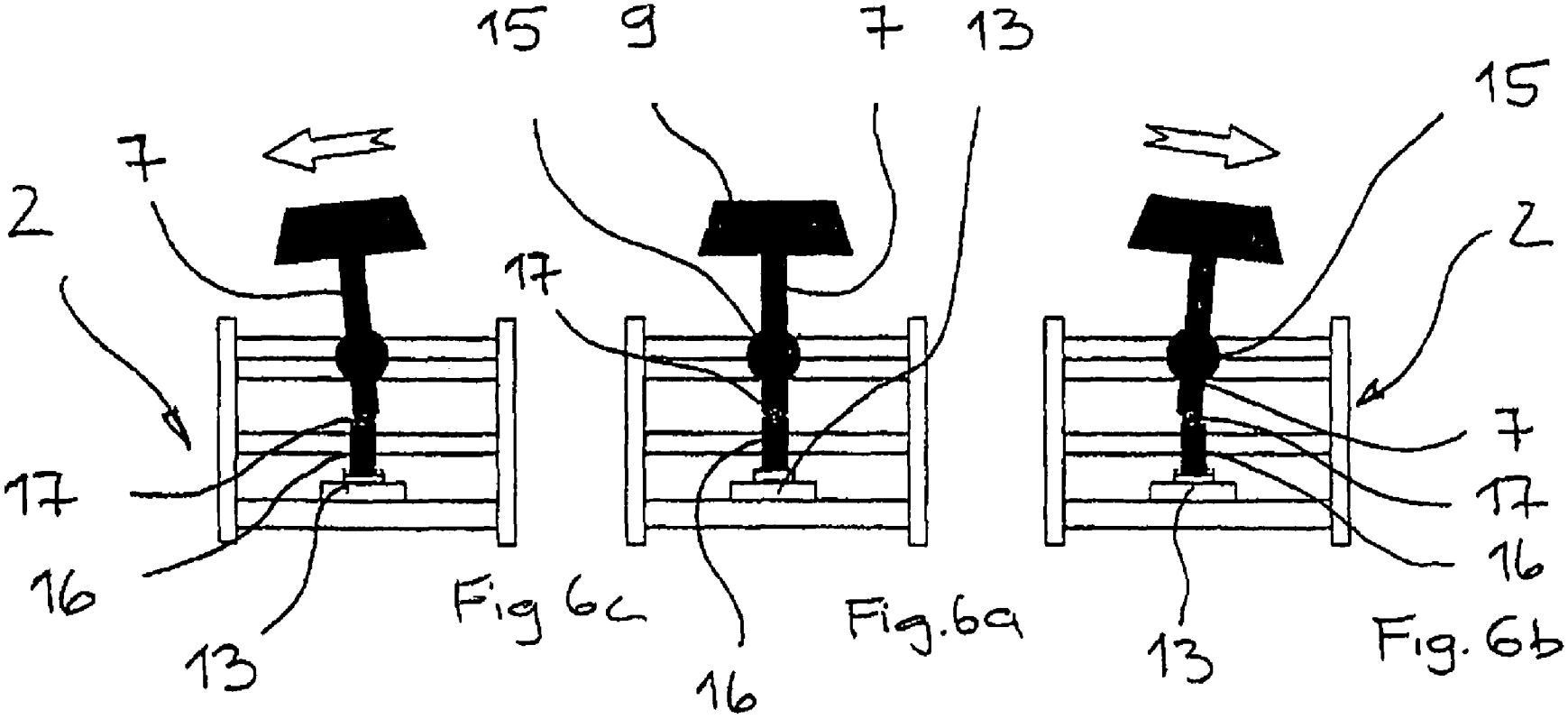
FIGS. 6*a* to 6*c* illustrate a schematic representation of a fourth embodiment of an inventive operating element in its home position and two switching positions.
Figure 7C:
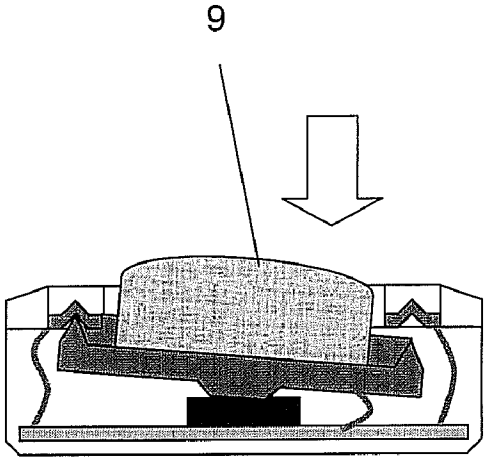
FIGS. 7*a* to 7*d* illustrate a schematic representation of a fifth embodiment of an inventive operating element in its home position and two switching positions, in addition to the contact area of the contact elements of the operating element.
Figure 7B:
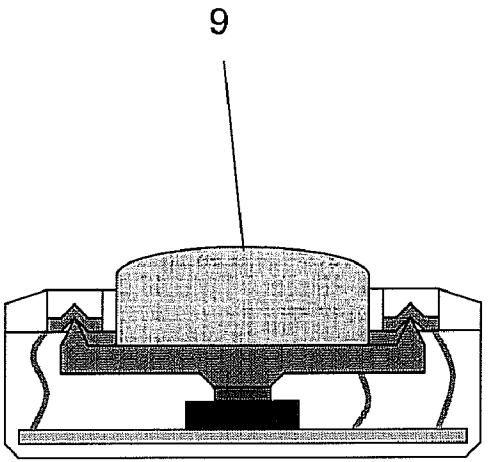
Figure 7A:
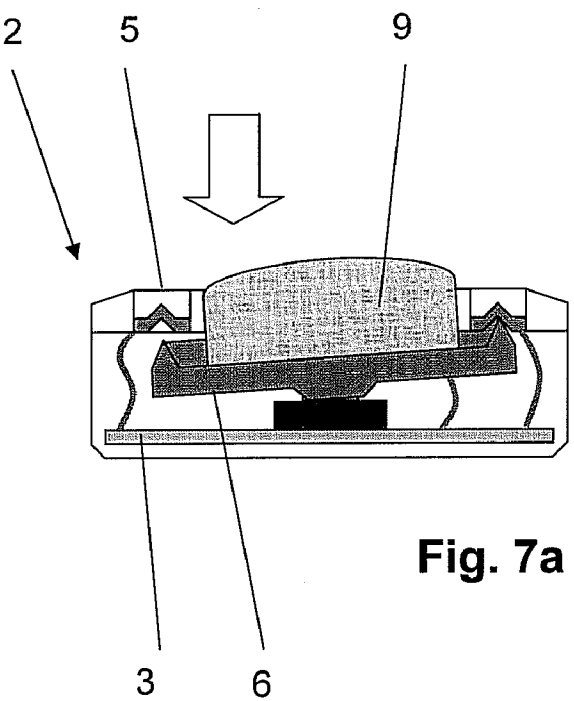
Figure 7D:
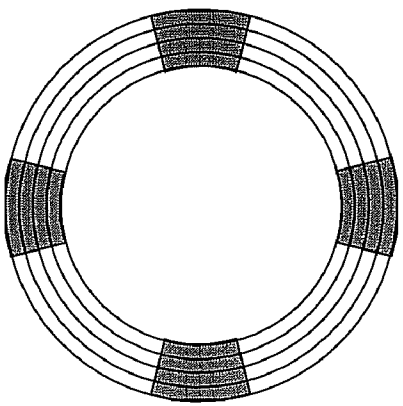

The embodiment shown in FIGS. 6*a* through 6*c* largely corresponds to the first embodiment shown in FIGS. 1*a* through 1*c*. Here, the shaft 7 is swivel-mounted in the housing 2 by means of a ball joint 15, and its lower end rests against a tappet 16 that is guided in the housing in a longitudinally movable fashion and whose underside contacts the momentary switch 13. In this context, the shaft 7 and the tappet 16 are coupled to one another by a ball 17 that lies in a conical recess in the upper face of the tappet 16. During a swivel motion of the shaft out of the home position shown in FIG. 6*a* into one of the switching positions shown in FIGS. 6*b* and 6*c*, this swivel motion is translated by the ball 17 into a linear motion of the tappet 16, so that the tappet is depressed or raised, actuating the momentary switch 13.

FIGS. 7*a* through 7*d* show a fifth embodiment of an inventive operating element which also largely corresponds to the first embodiment shown in FIGS. 1*a* through 1*c*. In contrast to the first embodiment, here only the shaft 7 either does not take or only as a projection the form of an elastic bearing stub 18 carrying the contact plate on its top, to which the control knob 9 in turn is directly attached.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An operating element comprising:

a control knob that is mounted in a housing or a console and moves in a swiveling manner between a home position and multiple switching or contact positions;

a central momentary switch for establishing a switch actuation point of the operating element, the central momentary switch including a haptic function that is associated with the control knob, the central momentary switch being actuated each time the control knob is swiveled out of its home position by a predefined angle toward a switching or contact position; and pairs of cooperating contact elements, one half of each pair being on the shaft of the control knob and the other half of the pair on the housing, wherein one of the pairs of contact elements works together in each contact position to provide contact, wherein the contact elements are provided at a contact surface in the form of an annular and V-shaped groove, and at a wedge-shaped ring that engages into the grove.

2. The operating element according to claim 1, wherein the momentary switch is depressed during a swiveling motion of the control knob out of its home position into a switching or contact position against a restoring force of an elastic element associated with the momentary switch.

3. The operating element according to claim 1, wherein the momentary switch is depressed when the control knob is in its home position, and is released and raised by an elastic element associated with the momentary switch when the control knob is swiveled into a switching or contact position.

4. The operating element according to claim 1, wherein the control knob is supported on the housing and pressed into its home position by at least one elastic element.

5. The operating element according to claim 1, wherein the control knob is located at a free end of a shaft, which is swivel-mounted substantially within the housing.

6. The operating element according to claim 5, wherein the momentary switch is associated with an end of the shaft that is opposite the control knob.

7. The operating element according to claim 6, wherein the end of the shaft opposite the control knob directly contacts the momentary switch.

8. The operating element according to claim 6, wherein, associated with the momentary switch is a tappet that is guided in a longitudinal direction and that contacts the momentary switch at one end and is operatively connected at a second end to the shaft in such a manner that a swiveling motion of the shaft is translated into an axial motion of the tappet.

9. The operating element according to claim 1, wherein the contact elements are designed as pressure-sensitive films.

10. The operating element according to claim 1, wherein the contact elements are designed to carry current and a circuit is closed in the event of a contact.

11. The operating element according to claim 1, wherein the contact elements are optical or magnetic sensors.

12. The operating element according to claim 1, wherein the contact elements are arranged such that the sensing of a switching position occurs at a smaller angle of tilt of the control knob than the switching function of the momentary switch.

13. The operating element according to claim 1, wherein the shaft is held in the housing by a ball bearing.

14. The operating element according to claim 1, wherein the control knob is moved axially out of its home position in order to actuate the momentary switch.

* * * * *